US007891780B2

(12) United States Patent
Ueda

(10) Patent No.: US 7,891,780 B2
(45) Date of Patent: Feb. 22, 2011

(54) LIQUID EJECTION HEAD AND PRODUCTION PROCESS THEREOF

(75) Inventor: Hikaru Ueda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 544 days.

(21) Appl. No.: 11/953,364

(22) Filed: Dec. 10, 2007

(65) Prior Publication Data

US 2008/0143790 A1 Jun. 19, 2008

(30) Foreign Application Priority Data

Dec. 15, 2006 (JP) ..... 2006-338175

(51) Int. Cl.
*B41J 2/05* (2006.01)

(52) U.S. Cl. ..... 347/65

(58) Field of Classification Search ..... 347/63, 347/40, 65

See application file for complete search history.

(56) References Cited

U.S. PATENT DOCUMENTS 4,657,631 A 4/1987 Noguchi
5,478,606 A 12/1995 Ohkuma et al.
7,282,243 B2 10/2007 Ohkuma et al.
2006/0007270 A1 * 1/2006 Kawamura ..... 347/63
2006/0230614 A1 10/2006 Imamura et al.

FOREIGN PATENT DOCUMENTS

JP 2001-063045 3/2001
JP 2003-034028 2/2003

* cited by examiner

*Primary Examiner*—Matthew Luu
*Assistant Examiner*—Lisa M Solomon
(74) *Attorney, Agent, or Firm*—Fitzpatrick, Cella, Harper & Scinto

(57) ABSTRACT

A liquid ejection head is constituted by a substrate provided with a plurality of energy generating elements used for ejecting a liquid and a plurality of liquid supply ports for supplying the liquid, and a plurality of flow passage forming members, disposed on the substrate, provided with a plurality of ejection outlets for ejecting the liquid supplied from the liquid supply ports and a plurality of flow passages for establishing communication between the liquid supply ports and the ejection outlets. One of the flow passage forming members for forming one of the flow passages for establishing communication with one of the ejection outlets and another one of the flow passage forming members for forming another one of the flow passages for establishing communication with another one of the ejection outlets are independently provided.

4 Claims, 5 Drawing Sheets

LIQUID EJECTION HEAD AND PRODUCTION PROCESS THEREOF

FIELD OF THE INVENTION AND RELATED ART

The present invention relates to a liquid ejection head for ejecting a liquid and a production process thereof. More specifically, the present invention relates to an ink jet recording head for effecting recording by ejecting ink droplets onto a recording medium.

As an embodiment of the liquid ejection head for ejecting a liquid, the ink jet recording head for effecting recording by ejecting ink droplets onto the recording medium has been known.

To the ink jet recording head, ejection openings for ejecting ink droplets and flow passages corresponding to the ejection openings are provided. The ink jet recording head having such a structure is suitable for image formation with a high density and high-speed recording and has been used for many recording apparatuses in these days.

U.S. Pat. Nos. 4,657,631 and 5,478,606 and Japanese Laid-Open Patent Applications 2001-063045 and 2003-034028 disclose liquid ejection heads each provided with a plurality of ejection openings on a substrate and flow passages communicating with the ejection openings and production process of the liquid ejection heads.

These general liquid ejection heads include energy generating elements for generating energy used for ejecting a liquid and a substrate provided with supply ports for supplying the liquid. Further, on the substrate, the ejection openings for ejecting the liquid and flow passages for guiding the liquid supplied from the supply ports to the ejection openings are provided. The flow passages are formed by a flow passage forming member.

The flow passage forming member can function as an orifice plate provided with the ejection openings and can also be provided separately from the orifice plate. In the former case, the flow passages are formed in the orifice plate and the orifice plate is the flow passage forming member. In the latter case, between the substrate and the orifice plate, the flow passage forming member different from the orifice plate is disposed.

However, the conventional liquid ejection heads have been accompanied with the following problem. Under an ordinary operation environment, the flow passage forming member or the orifice plate always contacts the liquid to be ejected. For this reason, the flow passage forming member or the orifice plate causes volume change by swelling, so that the ejection openings and the flow passages can be deformed.

The deformation of the ejection openings and the flow passages can cause deviation, thus hindering normal ejection. Especially, in the field of the ink jet recording head, the droplet may desirably be reduced in diameter from the viewpoint of improvement in resolution of a recording image or the like. For this reason, as a material for the flow passage forming member or the orifice plate, a resin material such as a photosensitive resin material with ease of processing is frequently used. However, the resin material is, compared with an inorganic material such as metal, liable to cause swelling. Particularly, an epoxy resin material is capable of providing a good pattern forming performance, so that it is used in the flow passage forming member in many cases. However, on the other hand, due to an oxygen density in its molecules, the epoxy resin material can be liable to cause the swelling. Further, in recent years, with the needs of further improvement in resolution, such a liquid ejection head that is capable of ejecting a droplet reduced in diameter to 2 pl (picoliters) or less is desired. In order to meet the needs, there are trends toward a smaller diameter of the ejection openings of the liquid ejection head and corresponding more minute flow passages. When the ejection openings and the flow passages are downsized as described above, an influence of the volume change of the flow passage forming member or the orifice plate providing the ejection openings and the flow passages is a major problem.

In order to prevent the volume change resulting from swelling, such methods that a swelling-preventing agent is added into or applied onto the flow passage forming member have been used conventionally. However, although the volume change resulting from swelling can be suppressed by the addition of the swelling-preventing agent, the swelling-preventing agent generally contains a water-repellent component. Accordingly, in many cases, it is difficult to add or apply the swelling-preventing agent with respect to a material for the flow passage forming member or the orifice plate, so that a selection latitude of the material can be impaired.

SUMMARY OF THE INVENTION

A principal object of the present invention is to provide a liquid ejection head less causing deformation of ejection openings and flow passages even when a flow passage forming member or an orifice plate causes a change in volume.

Another object of the present invention is to provide a production process of the liquid ejection head.

According to an aspect of the present invention, there is provided a liquid ejection head comprising:

a substrate provided with a plurality of energy generating elements used for ejecting a liquid and a plurality of liquid supply ports for supplying the liquid; and a plurality of flow passage forming members, disposed on the substrate, provided with a plurality of ejection outlets for ejecting the liquid supplied from the liquid supply ports and a plurality of flow passages for establishing communication between the liquid supply ports and the ejection outlets, wherein one of the flow passage forming members for forming one of the flow passages for establishing communication with one of the ejection outlets and another one of the flow passage forming members for forming another one of the flow passages for establishing communication with another one of the ejection outlets are independently provided.

According to another aspect of the present invention, there is provided a process for producing a liquid ejection head, comprising:

a step of preparing a substrate provided with a plurality of energy generating elements used for ejecting a liquid;

a step of forming a plurality of flow passage patterns for independently coating each of the energy generating element;

a step of forming a resin material layer for coating the plurality of flow passage patterns;

a step of partially removing the resin material layer so as to divide the resin material layer depending on the plurality of flow passage patterns;

a step of forming a plurality of openings each generating the substrate corresponding to each of the plurality of flow passage patterns; and a step of removing the plurality of flow passage patterns.

According to the present invention, it is possible to realize a liquid ejection head which causes less deformation of the ejection openings and flow passages even when the flow passage forming member or the orifice plate causes the volume change.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, an embodiment of the present invention and its comparative embodiment will be described with reference to the drawings.

Embodiment

Figure 1:
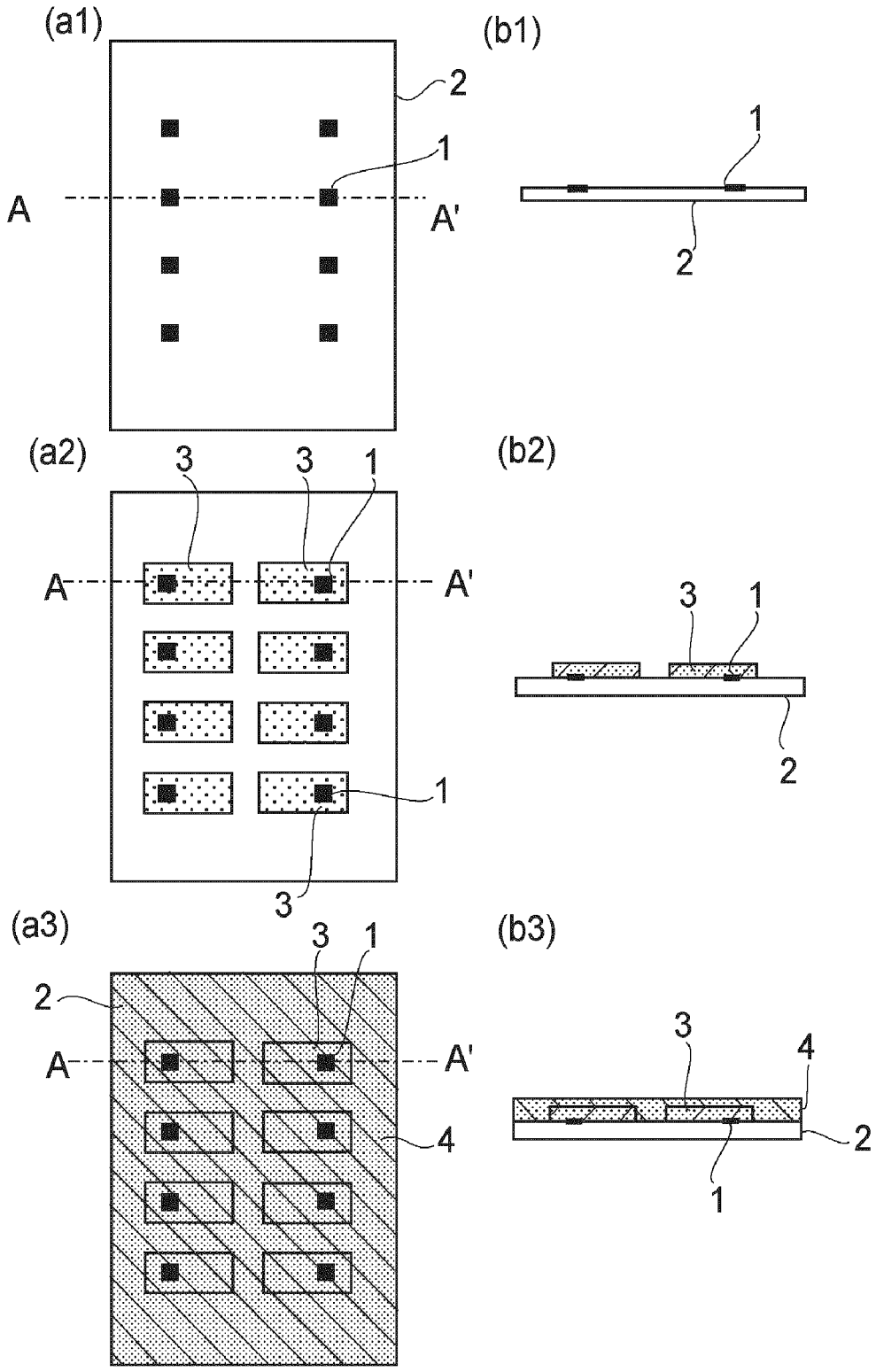
FIGS. 1(*a*1) to 1(*a*3) and 1(*b*1) to 1(*b*3) are schematic views for illustrating an example of the production process of a liquid ejection head in an embodiment of the present invention, wherein FIGS. 1(*a*1) to 1(*a*3) are plan views and FIGS. 1(*b*1) to 1(*b*3) are sectional views.

As shown in FIGS. 1(*a*1) and 1(*b*1), a substrate 2 on which a plurality of energy generating elements 1 for generating energy utilized for ejecting a liquid is provided is prepared.

Next, by using photolithography, as shown in FIGS. 1(*a*2) and 1(*b*2), an independent flow passage pattern 3 is formed on each of the energy generating elements 1 at the surface of the substrate 2. A material for the flow passage pattern 3 is identical to that for the flow passage pattern 3 used in Comparative Embodiment described later. In the photolithography, exposure is performed by using deep UV light (beam).

Then, as shown in FIGS. 1(*a*3) and 1(*b*3), on the entire surface of the substrate 2, a solid resin material is applied at room temperature to form a resin material layer 4 so as to coat (cover) two or more flow passage patterns 3 (all the flow passage patterns in this embodiment).

Figure 2:
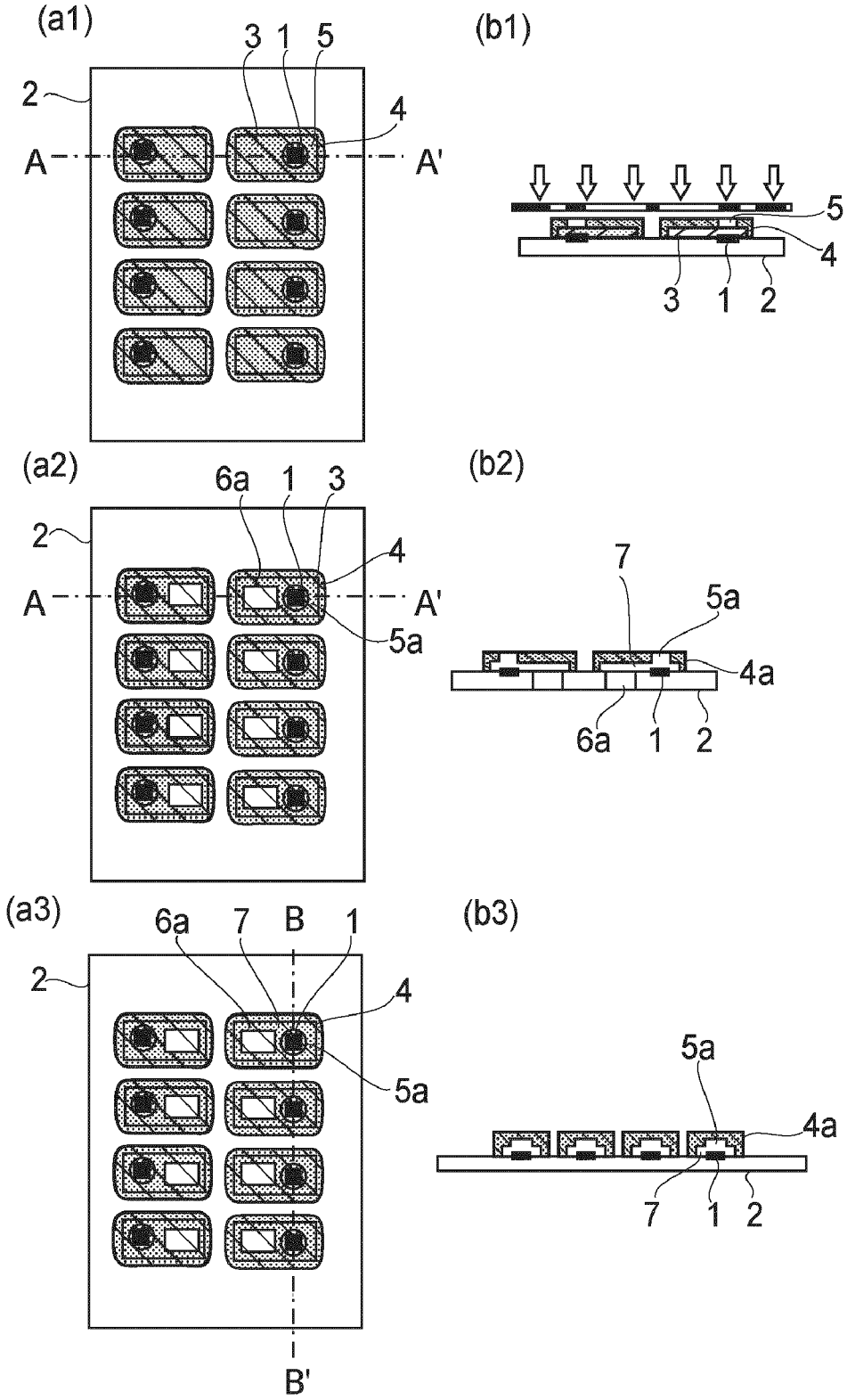
FIGS. 2(*a*1) to 2(*a*3) and 2(*b*1) to 2(*b*3) are schematic views for illustrating production steps subsequent to those shown in FIGS. 1(*a*1) to 1(*a*3) and 1(*b*1) and 1(*b*3), wherein FIGS. 2(*a*1) to 2(*a*3) are plan views and FIGS. 2(*b*1) to 2(*b*3) are sectional views.

Thereafter, as shown in FIGS. 2(*a*1) and 2(*b*1), by using photolithography, small holes 5 are formed at positions of the resin material layer 4 opposite to the respective energy generating elements 1 and at the same time, the resin material layer 4 is partially removed to expose a part of the surface of the substrate 2. Exposure is performed by using UV light. Specifically, the resin material layer 4 is divided into a plurality of independent portions each including a set of one energy generating element 1, one small hole 5 and one flow passage pattern 3. More specifically, by limiting an irradiation range of energy beam in the photolithography, a small hole 5-formed area, flow passage pattern 3-formed area, and a part of other areas in the entire surface area of the resin material layer 4 are left uncured. Thereafter, the uncured portions are removed in a developing step.

Next, the substrate 2 is subjected to etching at its back side to form openings 6 (liquid supply ports 6*a*) each penetrating the substrate 2 to reach an associated flow passage pattern 3. Then, a soluble resin material resin material constituting the flow passage patterns 3 is dissolved and removed through the openings 6 (liquid supply ports 6*a*) as shown in FIGS. 2(*a*2), 2(*b*2), 2(*a*3) and 2(*b*3).

Through the above-described steps, a liquid ejection head including one substrate 2, a plurality of ejection openings 5*a* formed on the substrate 2, a plurality of flow passages 7 each communicating with one of the ejection openings 5*a*, and a plurality of liquid supply ports 6a each communicating with one of the flow passages 7 is completed. The liquid ejection head in this embodiment has such a structure that a set of an ejection opening 5*a*, a flow passage 7 communicating with the ejection opening 5*a*, and a liquid supply port 6*a* communicating the flow passage 7 which are arranged in a one-to-one relationship is independent of another set.

The liquid supply port 6*a* has a size enough to supply a necessary amount of the liquid but the size of the liquid supply port 6*a* may appropriately be changed depending on a material for the substrate 2 or the like. Further, depending on a desired size, the liquid supply port 6*a* (opening 6) can be formed by appropriately selecting a known processing technique such as etching, sandblast, boring with a drill, or the like. In this embodiment, a chemical etching method using strong alkali is employed.

As described above, in the liquid ejection head in this embodiment, each of the flow passages 7 is formed by an independent orifice plate 4*a* (flow passage forming member). In other words, an upper surface and a side surface of the flow passages 7 are formed of the same material. However, the present invention is not limited thereto. For example, it is also possible to employ such a communication that an orifice plate provided with ejection openings and a flow passage forming member for forming flow passages are separately prepared and are disposed on a substrate as one member by combining the orifice plate with the flow passage forming member. Further, an adhesive layer may be provided as desired between the flow passages and the substrate. It is also possible to form the small holes resulting in the ejection openings in advance or after the flow passage forming member is formed on the substrate. Further, the energy generating elements may be formed between adjacent two liquid supply ports. In this case, two liquid supply ports 6*a* are provided with respect to one ejection opening 5*a* and one energy generating element 1. When two liquid supply ports 6*a* are symmetrically provided with respect to one energy generating element 1, it is possible to prevent deviation of an ejection direction, so that such a communication is suitable for image formation.

As a method of partially removing the resin material layer to divide the resin material layer into the plurality of portions depending on the flow passage patterns employed, it is possible to appropriately use a generally known mechanical processing method such as dry etching, machining, sandblast, or the like. This step may also be carried out simultaneously with or separately from a step of providing the small holes.

In this embodiment, a communication in which the plurality of ejection openings 5*a* is arranged in lines to form ejection opening arrays is employed. This communication for forming the ejection opening arrays by arranging the plurality of ejection openings in lines is suitable for efficient uniform ejection of various liquids and is widely employed in these days. When the liquid ejection head having such a communication is subjected to scanning in a direction perpendicular to an arrangement direction of the ejection openings, the efficient and uniform ejection is realized.

However, generally, due to a linear arrangement of ejection openings, a volume change resulting from swelling with respect to a direction parallel to a substrate is accumulated concentratedly on the line in which the ejection openings are arranged. Accordingly, compared with a communication in which the ejection openings are not arranged in lines, the ejection opening linear arrangement communication can cause a further adverse influence due to distortion.

Figure 3:
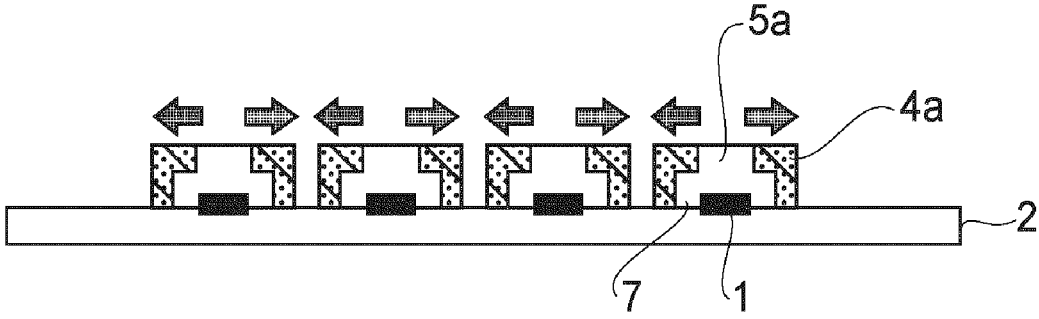
FIG. 3 is a schematic sectional view for illustrating a principle that deformation resulting from swelling is not accumulated in the liquid ejection head in the embodiment of the present invention.

In this embodiment of the present invention, however, a set of an ejection opening and a flow passage communicating with the ejection opening is independent of another set. Accordingly, the volume change resulting from swelling with respect to the direction parallel to the substrate is not accumulated, thus resulting in no occurrence of distortion. A state in which the volume change with respect to the direction parallel to the substrate in the liquid ejection head in this embodiment is shown in FIG. 3. Referring to FIG. 3, it can be understood that even when volume changes indicated by arrows are caused with respect to one orifice plate 4*a*, adjacent orifice plates 4*a* (ejection openings 5 and flow passages 7) are not adversely affected.

Further, to a production process in which a plurality of ejection openings is formed in a single member and a plurality of flow passages communicating with the ejection openings, respectively, is formed in the same (single) member, the production process in this embodiment is not inferior in terms of process (step) load and positional accuracy between respective ejection openings.

Further, in this embodiment, it is not necessary to add a swelling-preventing agent to the flow passage forming member, so that elusion of the swelling-preventing agent into the liquid does not occur.

When the liquid ejection head in this embodiment was actually filled with ink identical to that used in Comparative Embodiment described later and was subjected to observation after a lapse of a predetermined time, phenomena of deformation of the ejection openings and the flow passages, substrate bow, and separation of the orifice plate were not observed.

Further, when a liquid ejection apparatus using the liquid ejection head in this embodiment was subjected to ejections of various liquids, it was possible to stably effect ejections with accuracy for a long time.

Further, as in this embodiment, by independently providing the plurality of liquid supply ports 6*a* each corresponding to one of the ejection openings 5*a*, it is possible to alleviate an influence of a pressure, generated during ejection of the liquid, on adjacent flow passages. That is, the liquid ejection head in this embodiment is suitable for prevention of an influence of a so-called cross-talk phenomenon.

Comparative Embodiment

Figure 4:
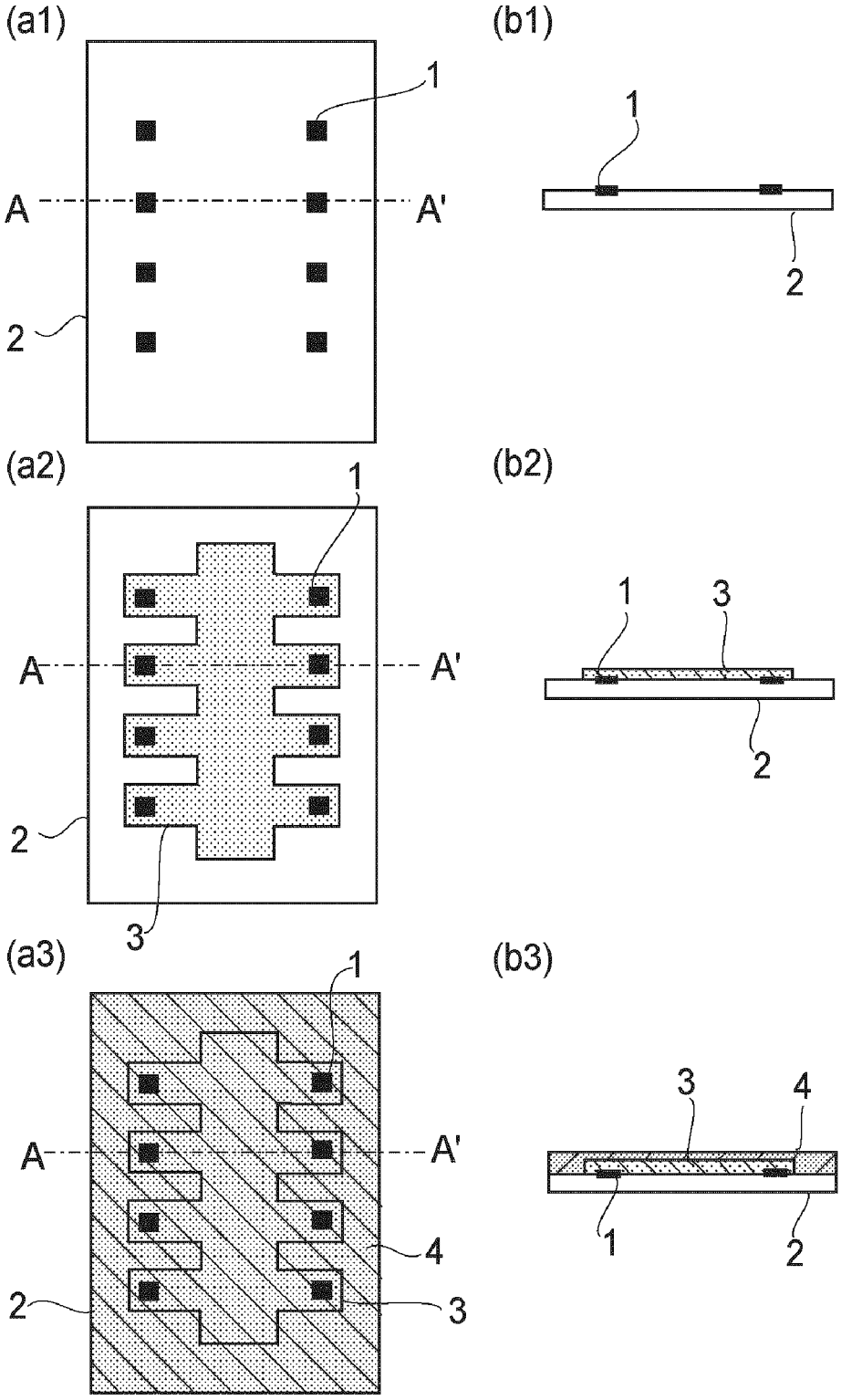
FIGS. 4(*a*1) to 4(*a*3) and 4(*b*1) to 4(*b*3) are schematic views for illustrating an example of the production process of a liquid ejection head in a comparative embodiment, wherein FIGS. 4(*a*1) to 4(*a*3) are plan views and FIGS. 4(*b*1) to 4(*b*3) are sectional views.
Figure 5:
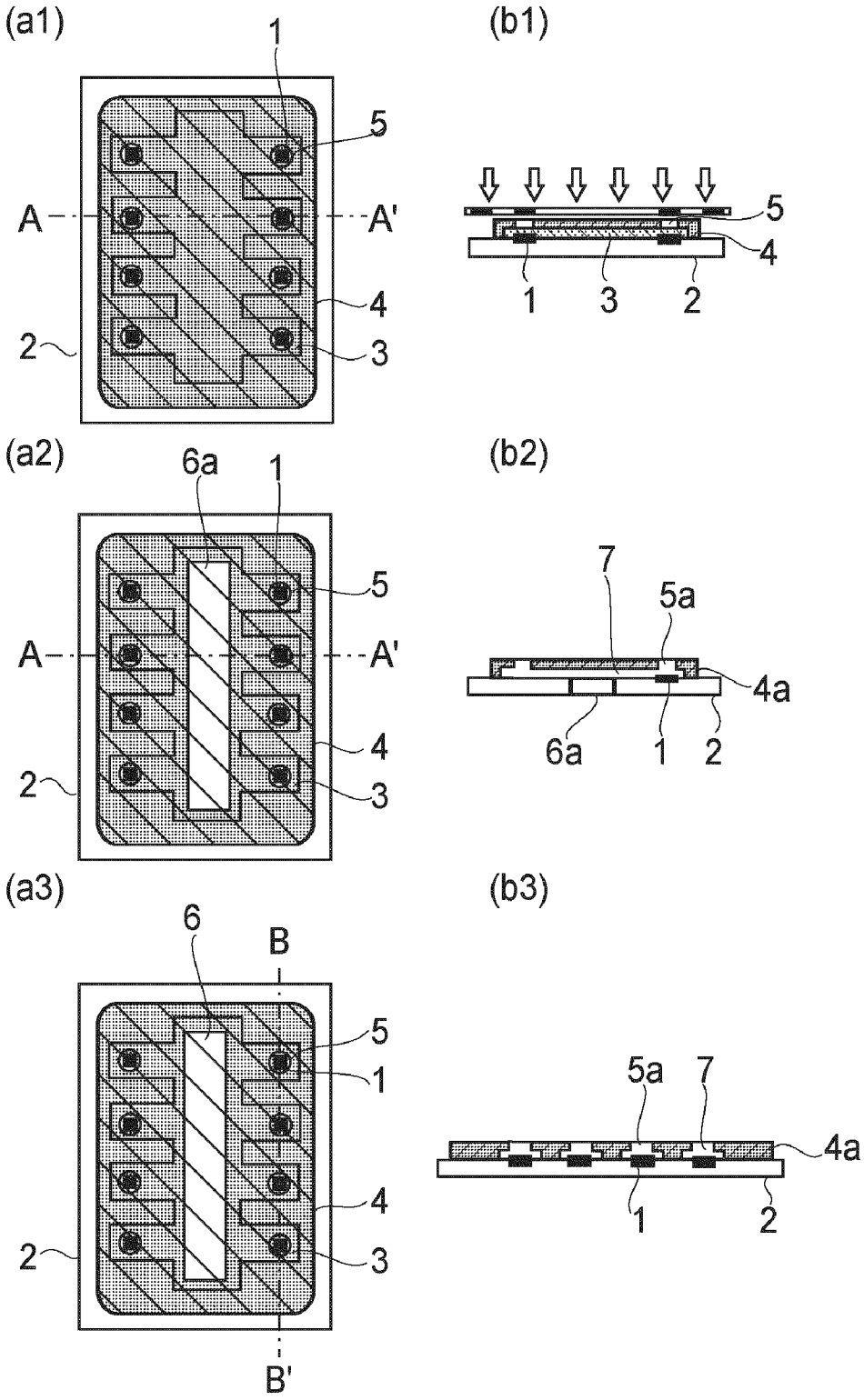
FIGS. 5(*a*1) to 5(*a*3) and 5(*b*1) to 5(*b*3) are schematic views for illustrating production steps subsequent to those shown in FIGS. 4(*a*1) to 4(*a*3) and 4(*b*1) and 4(*b*3), wherein FIGS. 5(*a*1) to 5(*a*3) are plan views and FIGS. 5(*b*1) to 5(*b*3) are sectional views.

As shown in FIGS. 4(*a*1) and 4(*b*1), a substrate 2 on which a plurality of energy generating elements 1 is provided is prepared (first step). Next, by using photolithography, as shown in FIGS. 4(*a*2) and 4(*b*2), a flow passage pattern 3 is formed of a soluble resin material on the substrate 2 on which the energy generating elements 1 are provided (second step). Then, as shown in FIGS. 4 (*a*3) and 4 (*b*3), on the entire surface of the substrate 2 including the flow passage pattern 3, a solid resin material is applied at room temperature to form a resin material layer 4 (third step). Thereafter, as shown in FIGS. 5(*a*1) and 5(*b*1), by using photolithography, small holes 5 are formed in the resin material layer 4 (fourth step).

Therefore, the substrate 2 is subjected to etching at its back side to form an opening 6 penetrating the substrate 2 to reach the flow passage pattern 3 (fifth step). Then, a soluble resin material constituting the flow passage pattern 3 is dissolved and removed through the opening 6 (liquid supply port 6*a*) as shown in FIGS. 5(*a*2), 5(*b*2), 5(*a*3) and 5(*b*3) (sixth step).

Through the above-described steps, a liquid ejection head including one substrate 2, a plurality of ejection openings 5*a* formed on the substrate 2 and a plurality of flow passages 7 communicating with the respective ejection openings 5*a* is completed. In the above-described fourth step, the small holes 5 formed in the resin material layer 4 are ejection openings (nozzles) 5*a* of the liquid ejection head and in the fifth step, the opening 6 provided in the substrate 2 is the liquid supply port 6*a*. Further, the resin material layer 4 is an orifice plate 4*a* and in the sixth step, a space remaining in the resin material layer 4*a* after the removal of the resin material is a flow passage 7. In the liquid ejection head in this comparative embodiment, the liquid is supplied from the liquid supply port 6*a* into the flow passage 7. The liquid in the flow passage 7 is ejected from the ejection opening 5*a* by energy generated by the energy generating element 1.

In the liquid ejection head in this comparative embodiment, the ejection openings 5*a* and the flow passages 7 are integrally formed in one orifice plate 4*a*. In other words, the plurality of ejection openings 5*a* and the plurality of flow passages 7 communicating with the ejection openings 5*a* are provided by a single member.

As the substrate 2, a silicon substrate is used and as the energy generating element 1, an electrothermal transducer element (heater) is used. As the soluble resin material for forming the flow passage pattern 3, a photodecomposition-type positive resist is used. As the solid resin material at room temperature for forming the resin material layer 4 (orifice plate 4*a*), an epoxy resin material composition capable of photo cation polymerization is used.

The above-prepared liquid ejection head was connected with a liquid supply system (not shown) and filled with a liquid (ink) ("BCI-8Bk", manufactured by Canon Inc.) and then left standing in a constant temperature bath at 60° C. for 6 months. Thereafter, when the ejection openings 5 and the flow passages 7 were observed in detail, minute deformation was confirmed at a part of the ejection openings 5. A schematic view for simply illustrating a state of the confirmed minute deformation is shown in FIG. 6.

Figure 6:
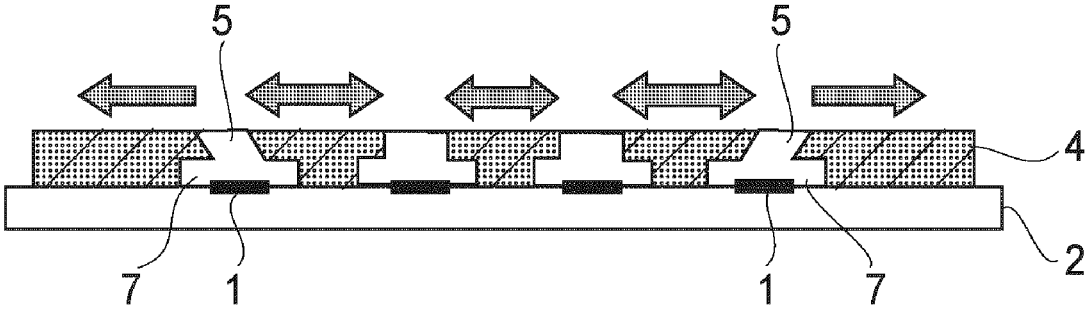
FIG. 6 is a schematic sectional view for illustrating a principle that deformation resulting from swelling is accumulated in the liquid ejection head in the comparative embodiment.

The reason why the deformation as shown in FIG. 6 occurred is swelling of the orifice plate 4. Specifically, with respect to one member (orifice plate 4) formed on the substrate 2, the plurality of ejection openings 5 and the plurality of flow passages 7 are provided, so that volume changes, resulting from swelling, indicated by arrows are accumulated in a plane parallel to the substrate 2, thus leading to a large distortion.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 338175/2006 filed Dec. 15, 2006, which is hereby incorporated by reference herein.

What is claimed is:

1. A liquid ejection head comprising:

a substrate provided with a plurality of energy generating elements used for ejecting a liquid and a plurality of liquid supply ports for supplying the liquid; and a plurality of flow passage forming members, disposed on said substrate, provided with a plurality of ejection outlets for ejecting the liquid supplied from the liquid supply ports and a plurality of flow passages for establishing communication between the liquid supply ports and the ejection outlets, wherein one of said flow passage forming members for forming one of the flow passages for establishing communication with one of the ejection outlets and another of said flow passage forming members for forming another of the flow passages for establishing communication with another of the ejection outlets are independently provided such that a gap is provided between a side wall of the one flow passage forming member and a side wall of the other flow passage forming member.

2. A head according to claim 1, wherein each of the liquid supply ports is provided corresponding to one of the ejection outlets.

3. A head according to claim 1, wherein each of ejection outlets is disposed opposite to one of the energy generating elements.

4. A head according to claim 1, wherein a pair of the liquid supply ports is provided with respect to one of the energy generating elements.

* * * * *